US010315425B2

(12) United States Patent
Tominaga et al.

(10) Patent No.: US 10,315,425 B2
(45) Date of Patent: Jun. 11, 2019

(54) METHOD OF PRODUCING STRUCTURE AND METHOD OF PRODUCING LIQUID DISCHARGE HEAD

(71) Applicant: CANON KABUSHIKI KAISHA, Tokyo (JP)

(72) Inventors: Yasuaki Tominaga, Kawasaki (JP); Tetsushi Ishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 15/589,682

(22) Filed: May 8, 2017

(65) Prior Publication Data

US 2017/0326880 A1 Nov. 16, 2017

(30) Foreign Application Priority Data

May 11, 2016 (JP) ..... 2016-095348

(51) Int. Cl.
*B41J 2/14* (2006.01)
*B41J 2/16* (2006.01)

(52) U.S. Cl.
CPC ..... *B41J 2/1631* (2013.01); *B41J 2/1404* (2013.01); *B41J 2/14145* (2013.01); *B41J 2/1603* (2013.01); *B41J 2/1628* (2013.01); *B41J 2/1639* (2013.01); *B41J 2/1645* (2013.01); *B41J 2002/14467* (2013.01)

(58) Field of Classification Search
CPC . B41J 2/14016; B41J 2/1631; H01L 21/31116
See application file for complete search history.

(56) References Cited

U.S. PATENT DOCUMENTS 5,963,232 A * 10/1999 Kasamoto ..... B41J 2/14024 347/58

FOREIGN PATENT DOCUMENTS

JP 2006-227544 A 8/2006
JP 2008-526553 A 7/2008

* cited by examiner

*Primary Examiner* — Julian D Huffman
(74) *Attorney, Agent, or Firm* — Canon U.S.A. Inc., IP Division

(57) ABSTRACT

Provided is a method of producing a structure including a substrate having openings in a first surface and a lid structure formed on the first surface and having an opening portion communicating with a part of the openings. The method includes preparing a laminate by forming a layer containing a photosensitive resin composition on a base film, stacking the laminate on the first surface such that the first surface is in contact with the photosensitive resin composition-containing layer, and forming a pattern for the opening portion of the lid structure in the photosensitive resin composition-containing layer by pattern exposure of the layer through the base film. The maximum scattering light intensity of the base film at a scattering angle of 10° or more is 1/100000 or less of the light intensity at a scattering angle of 0°, at a wavelength of 400 nm.

14 Claims, 4 Drawing Sheets

METHOD OF PRODUCING STRUCTURE AND METHOD OF PRODUCING LIQUID DISCHARGE HEAD

BACKGROUND OF THE INVENTION

Field of the Invention

The present disclosure relates to a method of producing a structure and a method of producing a liquid discharge head.

Description of the Related Art

In recent years, ink let recording apparatuses (liquid discharge recording apparatuses) for performing recording by discharging liquids such as inks have been required to have enhanced printing performance, in particular, high resolution and high-speed printing. As one method for satisfying these requirements, it is conceived to increase the number of pixels per unit area by microminiaturizing the ink droplets to be discharged and densifying the discharge opening array to realize high resolution and high-speed printing. However, the densification of the discharge opening array also densities the opening portions for supplying inks formed in the substrate surface on the opposite side to the discharge openings, resulting in difficulties in securing the adhesion surface areas of the member for forming the opening portions and the substrate and in preventing mixing of inks.

PCT Japanese Translation Patent Publication No. 2008-526553 discloses a method for bonding an ink feeding pipe to a liquid discharge head by bonding a polymer film having a channel manifold formed by laser processing to a supporting member for pitch conversion with a bonding layer therebetween. Japanese Patent Laid-Open No. 2006-227544 discloses a method for forming microspaces with high precision by laying a top plate on precise micro depressions, wherein a photosensitive laminate film composed of a supporting film and a photosensitive resin composition is attached to the depressions and pattern exposure is performed without removing the supporting film.

SUMMARY OF THE INVENTION

The method of producing a structure according to the present disclosure produces a structure including a substrate having a plurality of openings in a first surface and a lid structure formed on the first surface of the substrate and having an opening portion communicating with a part of the plurality of openings. The method includes, in the following order, preparing a laminate by forming a layer containing a photosensitive resin composition on a base film, stacking the laminate on the first surface of the substrate such that the first surface is in contact with the photosensitive resin composition-containing layer, and forming a pattern for the opening portion of the lid. structure in the photosensitive resin composition-containing layer by pattern exposure of the photosensitive resin. composition-containing layer through the base film The maximum scattering light intensity of the base film at a scattering angle of 10° or more is 1/100000 or less of the light intensity at a scattering angle of 0°, at a wavelength of 400 nm.

The method of producing a liquid discharge head according to the present disclosure produces a liquid discharge head including a substrate having a plurality of openings in a first surface and an energy-generating element generating energy for discharging a liquid disposed on a second surface on the side opposite to the first surface, a lid structure formed on the first surface of the substrate and having an opening portion communicating with a part of the plurality of openings, and a passage-forming member formed on the second surface of the substrate and having a discharge opening for discharging a liquid and a passage for the liquid. The method includes, in the following order, preparing a laminate by forming a layer containing a photosensitive resin composition on a base film, stacking the laminate on the first surface of the substrate such that the first surface is in contact with the photosensitive resin composition-containing layer, and forming a pattern for the opening portion of the lid structure in the photosensitive resin composition-containing layer by pattern exposure of the photosensitive resin composition-containing layer through the base film. The maximum scattering light intensity of the base film at a scattering angle of 10° or more is 1/100000 or less of the light intensity at a scattering angle of 0°, at a wavelength of 400 nm.

Further features of the present disclosure will become apparent from the following description of exemplary embodiments with reference to the attached drawings.

DESCRIPTION OF THE EMBODIMENTS

Figure 1:
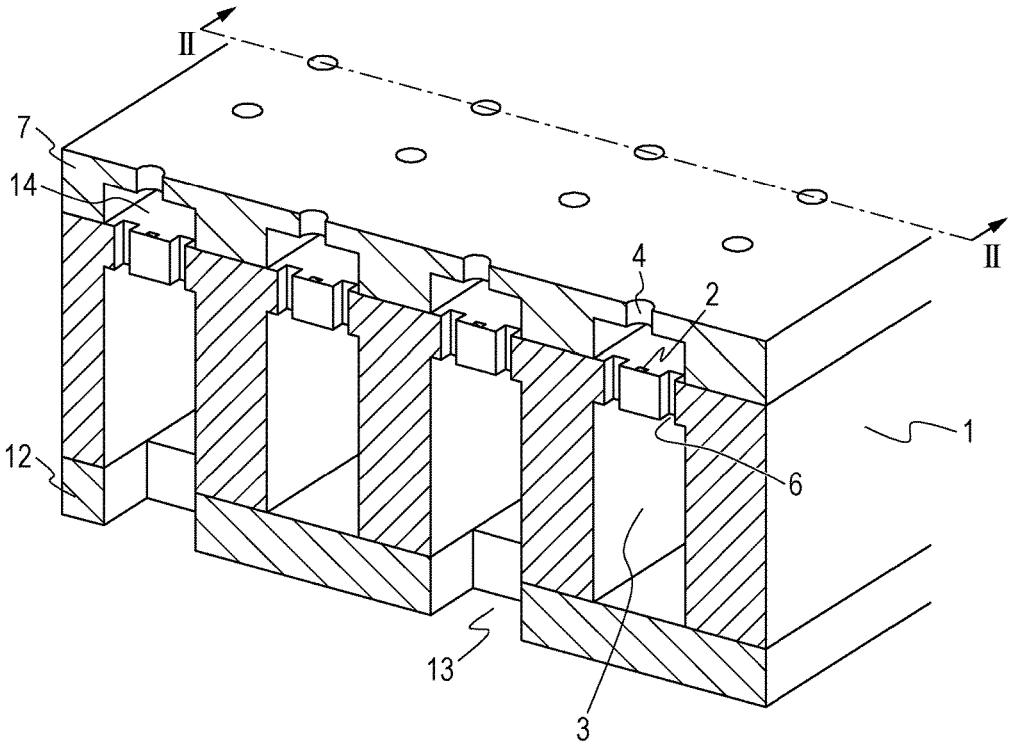
FIG. 1 is a schematic cross-sectional view illustrating an example of the liquid discharge head produced by an example method of producing a liquid discharge head.

In the method described in PCT Japanese Translation Patent Publication No. 2008-526553, since a polymer film is attached to a supporting member by laser processing, the processing accuracy and the densification have limitations. In addition, the present inventors have found by detailed investigation of the method described in Japanese Patent Laid-Open No. 2006-227544 that the filler contained in the supporting film (base film) causes scattering of exposure light to reduce the patterning accuracy, resulting in a risk of blocking the portion to be opened.

The base film on which the photosensitive resin composition-containing layer is formed is generally a PET film, because PET films have excellent light transmittance and chemical resistance. In general, PET films each contain a filler as an anti-blocking material for preventing blocking between the films and have protrusions on the surface. Consequently, in pattern exposure of a layer containing a photosensitive resin composition through a PET film, an opening portion cannot have a good pattern shape due to light scattering caused by surface protrusions and light scattering caused by a difference in the refractive index of the film material and the filler. The present disclosure provides a structure including a lid structure having a good opening shape.

The method of producing a structure according to the present disclosure produces a structure including a substrate having a plurality of openings in a first surface and a lid structure formed on the first surface of the substrate and having an opening portion communicating with a part of the plurality of openings. The method includes, in the following order: a step of preparing a laminate by forming a layer containing a photosensitive resin composition on a base film; a step of stacking the laminate on the first surface of the substrate such that the first surface is in contact with the photosensitive resin composition-containing layer; and a step of forming a pattern for the opening portion of the lid structure in the photosensitive resin composition-containing layer by pattern exposure of the photosensitive resin composition-containing layer through the base film. The maximum scattering light intensity of the base film at a scattering angle of 10° or more is 1/100000 or less of the light intensity at a scattering angle of 0°, at a wavelength of 400 nm.

The method of producing a structure according to the present disclosure uses a base film exhibiting a maximum. scattering light intensity at a scattering angle of 10° or more being 1/100000 or less of the light intensity at a scattering angle of 0°, at a wavelength of 400 nm. Consequently, even in the pattern exposure is performed to the photosensitive resin composition-containing layer through the base film, the exposure light is prevented from scattering. Therefore, the patterning accuracy of the opening portion of the lid structure is improved, and a lid structure having a good opening shape can be formed. The method of producing a structure according to the present disclosure can be suitably used as a method of producing a liquid discharge head shown below.

The method of producing a liquid discharge head according to the present disclosure produces a liquid discharge head including a substrate, a lid structure, and a passage-forming member. The substrate has a plurality of openings in a first surface and an energy-generating element generating energy for discharging a liquid disposed on a second surface on the side opposite to the first surface. The lid structure is formed on the first surface of the substrate and has an opening portion communicating with a part of the plurality of openings. The passage-forming member is formed on the second surface of the substrate and has a discharge opening for discharging a liquid and a passage for the liquid. The method of producing a liquid discharge head according to the present disclosure includes the same steps as those in the method of producing a structure. The method can easily produce a liquid discharge head including a lid structure having a highly accurate opening portion.

An example embodiment of the method of producing a liquid discharge head will now be described with reference to the drawings, but the present invention is not limited thereto. In the following embodiment, an ink jet recording head will be described as an application example, but the application range is not limited thereto, and the present disclosure can also be applied to, for example, production of biochips or recording heads for printing of electronic circuits. Examples of the liquid discharge head include heads for producing color filters, in addition to the ink jet recording head. The liquid discharge head is mountable on an apparatus, such as a printer, a copier, a facsimile, or a word processor having a printer unit, and also an industrial recording apparatus combined with a variety of processors. For example, the liquid discharge head is also mountable on an apparatus used for, for example, production of biochips, printing of electronic circuits, and spraying of chemicals.

An example of the liquid discharge head produced by the method according to the present disclosure is shown in FIG. 1. In a substrate 1 shown in FIG. 1, energy-generating elements 2 applying energy to a liquid such as an ink for discharging, common liquid chambers 3 retaining the liquid, supply passages 6 for supplying the liquid from the common liquid chambers 3 to respective passages 14, and wiring (not shown) connected to the energy-generating elements 2 are formed. The surface of the substrate 1 on the side of the energy-generating element 2 is denoted as a second surface, and the surface on the side opposite to the second surface is denoted as a first surface. In addition, a passage-forming member 7 is disposed. on. the second surface of the substrate 1 provided with the energy-generating elements 2. The passage-forming member 7 has discharge openings 4 for discharging a liquid and passages 14 for the liquid to be supplied to the discharge openings 4. In addition, a lid structure is disposed on the first surface on the side opposite to the second. surface of the substrate 1. The lid substrate 12 has opening portions 13 for introducing a liquid to the respective common liquid chambers 3. The lid structure 12 blocks a part of the plurality of openings formed by the common liquid chambers 3 of the substrate 1, and the opening portions 13 are communicated with the common liquid chambers 3.

A liquid introduced from the opening portion 13 of the lid structure 12 is retained in the common liquid chamber 3 and is supplied to the passage 14 through the supply passage 6. According to a recording signal, the energy-generating element 2 applies energy to the liquid, and the liquid is discharged from the discharge opening 4. For example, in the case of using an electrothermal converter as the energy-generating element, bubbles are momentarily generated in the liquid, and a change in the pressure occurring by the growth of the bubbles is utilized for discharging a liquid droplet from the discharge opening 4.

An example of the method of producing a liquid discharge head is shown in FIGS. 2A to 2H. FIGS. 2A to 2H are flow diagrams illustrating steps of the method of producing a liquid discharge head in the embodiment, and show a part of a cross-section in each step when the liquid discharge bead shown in FIG. 1 is cut in the direction perpendicular to the surface of the substrate 1 along the dashed line II-II.

Figure 2A:
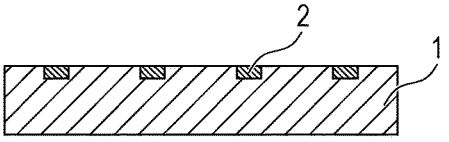
FIGS. 2A to 2H are schematic cross-sectional views illustrating an example of the method of producing a liquid discharge head.

As shown in FIG. 2A, a substrate 1 having energy-generating elements 2 is first prepared. In addition to the energy-generating elements 2, the substrate 1 is provided with electrical connections (not shown), such as electrodes for inputting control signals for driving the energy-generating elements 2. Inc substrate 1 can be a silicon substrate, which permits to easily use a known semiconductor production technique in the formation of the energy-generating elements 2, the electrodes, and so on. The energy-generating element 2 can be, for example, an electrothermal converter. In addition, a protective layer for improving the durability of the energy-generating elements 2 may be formed on the second surface provided with the energy-generating elements 2 of the substrate 1. In the subsequent description, one liquid discharge head unit will be described with reference to the drawings, but it is also possible to simultaneously produce a plurality of liquid discharge head units on a piece of a wafer of 6 to 12 inches as the substrate 1 and finally cut the wafer into each liquid discharge head.

Figure 2B:
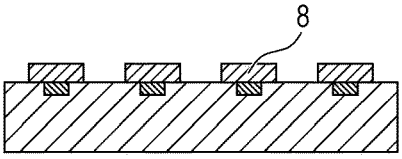

Next, as shown in FIG. 2B, a mold member 8 provided with a pattern of passages 14 is formed on the second surface of the substrate 1. Examples of the material for the mold member 8 include resin materials, such as photosensitive resins, and inorganic materials, such as metals. Any photosensitive resin can be used. For example, a positive photosensitive resin can be used, and examples thereof include main chain decomposition-type photosensitive resins of polymers containing polymethyl isopropenyl ketone or methacrylate as the main components. These resins may be used alone or in combination of two or more thereof. desired pattern can be formed in a layer containing a positive photosensitive resin by exposing the positive photosensitive resin to light having an optimum exposure wavelength. In the case of using a photosensitive resin as the material for the mold member 8, the mold member 8 can be formed by, for example, applying the photosensitive resin to the substrate 1 or stacking a film of the photosensitive resin on the substrate 1 to form a layer containing the photosensitive resin on the substrate 1 and patterning the layer into the shape of the passages 14 by, for example, photolithography.

Figure 2C:
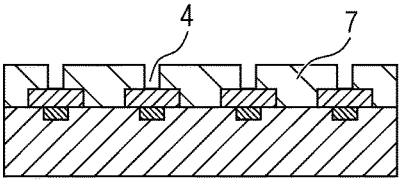

Then, as shown in FIG. 2C, a passage-forming member 7 having discharge openings 4 is formed on the substrate 1 and the mold member 8. The passage-forming member 7 may be formed from any material, but from the viewpoint of forming the discharge openings 4, a negative photosensitive resin composition can be used. Examples of the negative photosensitive resin composition include negative photosensitive resin compositions utilizing radical polymerization and negative photosensitive resin compositions utilizing cationic polymerization, described below. Usable commercially available examples of the negative photosensitive resin composition include "SU-8 series" and "KMPR-1000" (trade names, manufactured by Nippon Kayak Co., Ltd.) and "TMMR S2000" and "TMMF S2000" (trade names, manufactured by Tokyo Ohka Kogyo Co., Ltd.) These negative photosensitive resin compositions may be used alone or as a mixture of two or more thereof. The negative photosensitive resin composition can further optionally contain an additive and other auxiliaries. In the case of using a negative photosensitive resin composition as the material for the passage-forming member 7, the negative photosensitive resin composition may be coated on the substrate 1 and the mold member 8 by any method, for example, appropriately selected method from spin coating, laminating, and spray coating. The discharge openings 4 can be formed in the passage-forming member 7 by exposing a layer becoming the passage-forming member to light through a photomask and performing development. In addition, in order to improve the adhesion between the substrate 1 and the passage-forming member 7, an intermediate layer (not shown in FIG. 2C) may be formed between the substrate 1 and the passage-forming member 7.

Figure 2D:
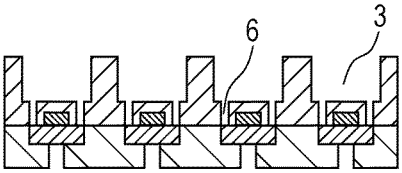

Then, as shown in FIG. 2D, common liquid chambers 3 and supply passages 6 are formed on the first surface side of the substrate 1. When the substrate 1 is a silicon substrate, the common liquid chambers 3 and the supply passages 6 can be formed in the substrate 1 by dry etching involving a Bosch process which effectively permits high aspect ratio processing. The common liquid chambers 3 and the supply passages 6 may be formed by another method, such as dry etching or anisotropic wet etching using an aqueous tetramethylammonium hydroxide solution. In the case of forming the common liquid chambers 3 and the supply passages 6 by etching treatment, from the viewpoint of protecting the passage-forming member 7, the surface and the circumference of the substrate 1 are coated with a rubber resin in advance, and the rubber resin can be removed after the etching treatment.

Figure 2E:
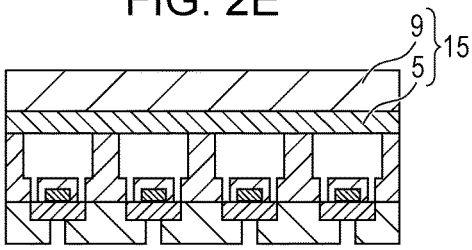

Then, as shown in FIG. 2E, a layer 5 containing a photosensitive resin composition is formed on a base film 9 to prepare a laminate 15, and the laminate 15 is stacked on the first surface of the substrate 1 such that the first surface is in contact with the photosensitive resin composition-containing layer 5. The photosensitive resin composition -containing layer 5 becoming a lid structure 12 may contain the photosensitive resin composition or may consist of the photosensitive resin composition. The photosensitive resin composition may be any photosensitive resin composition, but from the viewpoint of forming opening portions in the post-process and allowing to function as a lid structure, a negative photosensitive resin composition can be used. Examples of the negative photosensitive resin composition include negative photosensitive resin compositions utilizing radical polymerization and negative photosensitive resin compositions utilizing cationic polymerization.

The negative photosensitive resin composition utilizing radical polymerization cures by progress of polymerization or bridge formation between molecules of a radical polymerizable monomer or prepolymer contained in the photosensitive resin composition by means of radicals generated from a photopolymerization initiator contained in the photosensitive resin composition. Examples of The photopolymerization initiator include benzoins, benzophenones, thioxanthenes, anthraquinones, acylphosphine oxides, titanocenes, and acridines. Examples of the radical polymerizable monomer and prepolymer include monomers and prepolymers having an acryloyl group, a methacryloyl group, an acrylamide group, a maleic acid diester, or an allyl group. These monomers and prepolymers may be used alone or in combination of two or more thereof.

The negative photosensitive resin composition utilizing cationic polymerization cures by progress of polymerizaton or bridge formation between molecules of a cationic polymerizable monomer or prepolymer contained in the photosensitive resin composition by means of cations generated from a cationic photopolymerization initiator contained in the photosensitive resin. composition. Examples of the cationic photopolymerization initiator include aromatic iodonium salts and aromatic sulfonium salts. Examples of the cationic polymerizable monomer and prepolymer include monomers and prepolymers having an epoxy group, a vinyl ether group, or an oxetane group. These monomers and prepolymers may be used alone or in combination of two or more thereof.

Usable commercially available examples of the negative photosensitive resin composition include "SU-8 series" and "KMPR-1000" (trade names, manufactured by Nippon Kayaku Co., Ltd.) and "TMMR S2000" and "TMMF S2000" (trade names, manufactured by Tokyo Ohka Kogyo Co., Ltd.). These negative photosensitive resin compositions may be used alone or as a mixture of two or more thereof. The negative photosensitive resin composition can further optionally contain an additive and other auxiliaries.

The base film 9 used is a base film exhibiting a maximum scattering light intensity at a scattering angle of 10° or more being 1/100000 or less (herethafter, also referred to as intensity ratio) of the light intensity at a scattering angle of 0°, at a wavelength of 400 nm. An intensity ratio of 1/100000 or less can sufficiently prevent gelation of the photosensitive resin composition due to the scattering light at a scattering angle of 10° or more to improve the patterning accuracy of the photosensitive resin composition-containing layer 5 becoming the lid structure 12. Accordingly, a lid structure 12 having a good opening shape can be formed. In contrast, if the intensity ratio is higher than 1/100000, the patterning accuracy of the photosensitive resin composition-containing layer 5 becoming the lid structure 12 decreases, resulting in a difficulty in preparation of a lid structure 12 having opening portions 13 with a desired shape. Furthermore, if the exposure is performed with a high exposure dose for, for example, providing adhesion, the opening portions 13 are blocked in some cases. The intensity ratio is preferably 1/200000 or less, more preferably 1/300000 or less, and most preferably 1/400000 or less. A lower intensity ratio value can more sufficiently prevent gelation of the photosensitive resin composition, and there is no lower limit of the intensity ratio. The intensity ratio is the value obtained by measuring the scattering light intensity at a scattering angle of 10° or more and the light intensity at a scattering angle of 0° with GCMS-3B (trade name, manufactured by Murakami Color Research Laboratory) at a wavelength of 400 nm.

The base film 9 preferably has a surface roughness Sa of 10.0 nm or less, more preferably 5.0 nm or less, more preferably 3.0 nm or less, and most preferably 2.0 nm or less. When the base film 9 contains a filler as in a usual PET film, the filler form protrusions on the surface of the base film 9 in some cases. In such a case, if the pattern exposure of the photosensitive resin composition-containing layer 5 is performed through the base film 9, light scattering may be caused by the surface protrusions. However, a reduction of the surface roughness Sa to 10.0 nm or less suppresses light scattering and can more precisely form the opening portions 13 of the lid structure 12. In addition, even is the exposure is performed with a high exposure dose for, for example, providing adhesion, blocking of the opening portions 13 can be further prevented from occurring. The surface roughness Sa is the value calculated from an image of 936.70 μm in length and 703.78 μm in breadth with VertScan (trade name, manufactured by Ryoka Systems Inc.).

The base film 9 preferably has a contact angle with pure water of 80° or more and less than 120°, more preferably 90° or more and 110° or less, and most preferably 95° or more and 105' or less. A contact angle with pure water of 80° or more allows the base film 9 to be easily released from the photosensitive resin composition-containing layer 5 after exposure and past exposure bake (PEE). Accordingly, breakage of the photosensitive resin composition-containing layer 5 during the release process can be prevented. In addition, if the contact angle with pure water is less than 120°, the photosensitive resin composition is not repelled from the surface of the base film 9 when the photosensitive resin composition is applied to the surface of the base film 9, and a uniform layer can be formed. The contact angle with pure water is a value measured with a contact angle meter CA-X150 (trade name, manufactured by Kyowa Interface Science Co., Ltd.).

The base film 9 can avoid from being subjected to release treatment. Herein, the release treatment means that a release agent is applied to the surface of the base film 9. In general, a base film 9 provided with a photosensitive resin composition-containing layer 5 is subjected to release treatment in order to improve the release properties between the photosensitive resin composition-containing layer 5 and the base film 9. However, if the base film 9 is subjected to release treatment, the release agent transfers to the photosensitive resin composition-containing layer 5 to reduce the adhesiveness between the photosensitive resin composition-containing layer 5 and the substrate 1, resulting in a risk of a decrease in the yield rate. The base film 9 is not subjected to release treatment, and thereby no release agent transfers to the photosensitive resin composition-containing layer 5, and a reduction in the adhesiveness between the photosensitive resin composition-containing layer 5 and the substrate 1 can be prevented.

The amount of the filler contained in the base film 9 varies depending on the polymer constituting the base film 9 and the type of the filler and is preferably 3000 mass ppm or less, more preferably 1000 mass ppm or less, and most preferably 500 mass ppm or less. A smaller amount of the filler can further reduce the surface roughness, and there is no lower limit in the amount range of the filler. An amount of the filler contained in the base film 9 of 3000 mass ppm or less can adjust the ratio of the scattering light intensity at a scattering angle of 10° or more to the light intensity at a scattering angle of 0° within the range according to the present disclosure and also can prevent the filler from dropping to the photosensitive resin composition when the base film 9 is released from the photosensitive resin composition-containing layer 5. The filler contained in the base film 9 is, for example, a filler satisfying the anti-blocking performance of the base film 9, and examples thereof include minerals, such as talc, diatomite, and calcium carbonate; silicas, such as agglomerated silica and spherical silica; and polymer beads, such as polymethyl methacrylate (PMM) polymerized by, for example, suspension polymerization or emulsion polymerization. The base film 9 may contain one or more of these fillers.

The polymer contained in the base film 9 can be polypropylene, polyethylene terephthalate (PET), polyethylene naphthalate, polyimide, a cycloolefin polymer, or a cycloolefin copolymer. The base film 9 may contain one or more of these polymers. Among these polymers, at least one member selected from the group consisting of cycloolefin polymers and cycloolefin copolymers can be particularly used. The use of these polymers can adjust the ratio of the scattering light intensity at a scattering angle of 10° or more to the light intensity at a scattering angle of 0° and the contact angle with pure water within the respective ranges. The base film 9 can contain at least one member selected from the group consisting of cycloolefin polymers and cycloolefin copolymers in an amount of preferably 80 mass % or more, more preferably 90 mass % or more, and most preferably 95 mass % or more. The base film 9 may be made of at least one member selected from the group consisting of cycloolefin polymers and cycloolefin copolymers. Examples of commercially available cycloolefin polymer film and cycloolefin copolymer film include Zeonor Film ZF14 and Zeonor Film ZF16 (trade names, manufactured by Zeon Corporation), Transparent Heat-Resistant COC Film (F Film) (trade name, manufactured by Gunze Limited), Aron Film (trade name, manufactured by JSR Corporation), and Apel (trade name, manufactured by Mitsui Chemicals Inc.).

The base film 9 preferably has a thickness of 10 to 200 μm, more preferably 20 to 100 μm, and most preferably 30 to 70 μm.

The photosensitive resin composition-containing layer 5 may be formed on the base film 9 by any method, for example, by applying a photosensitive resin composition onto a base film 9 through spin coating, slit die coating, or spray coating. The photosensitive resin composition-containing layer 5 preferably has a thickness of 2 to 200 μm, more preferably 3 to 100 μm, and most preferably 5 to 30 μm.

The laminate 15 is stacked on the first surface of the substrate 1 by, for example, a method using a laminating apparatus. For example, a laminate 15 is placed on the first surface of a substrate 1 such that the first surface is in contact with the photosensitive resin composition-containing layer 5, and then laminating is performed with a laminating apparatus. The laminating may be performed under any conditions, and the conditions can be appropriately selected.

Figure 2F:
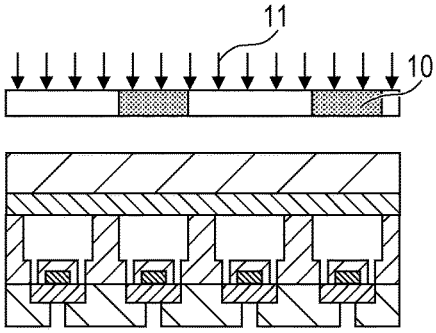

Then, as shown in FIG. 2F, the laminate 15 is irradiated with exposure light 11 through a mask 10 having a pattern of the opening portions 13 of the lid structure 12. On this occasion, the photosensitive resin composition-containing layer 5 is subjected to pattern exposure through the base film 9. Consequently, a pattern for the opening portions 13 of the lid structure 12 is formed in the photosensitive resin composition-containing layer 5. The exposure light may be any type that can cure the photosensitive resin composition-containing layer 5 and can transmit through the base film 9, and ultraviolet light can be used. Specifically, the wavelength of the exposure light 11 is preferably 250 to 450 nm and more preferably 300 to 400 nm. In particular, i-rays (wavelength: 365 nm) can be used as the exposure light 11. The exposure dose of the exposure light 11 can be appropriately selected depending on the photosensitive resin composition used.

Figure 2G:
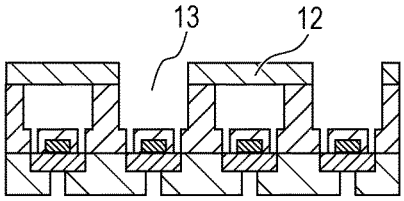

Then, as shown in FIG. 2G, the base film 9 is peeled from the photosensitive resin composition-containing layer 5, and PEB is then optionally performed. The photosensitive resin composition-containing layer 5 is subjected to a development process to form a lid structure 12 having the opening portions 13. The conditions for the PEB and the development process can be appropriately selected depending on the photosensitive resin composition used. The thickness of the lid structure 12 varies depending on the size of the opening portions 13 and the flow rate and viscosity of the liquid to be supplied and is preferably 2 to 200 μm, more preferably 3 to 100 μm, and most preferably 5 to 30 μm. The opening portions 13 may have any size.

Figure 2H:
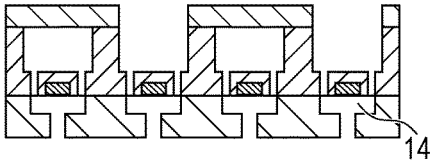

Then, as shown in FIG. 2H, the mold member 8 is removed to form passages 14. For example, after irradiation with Deep-UV light, the mold member 8 can be dissolved and removed by immersion in a solvent. After the mold member 8 is removed, a cure process may be performed. According to the process described above, a liquid discharge head can be provided.

EXAMPLES

Embodiments of the present disclosure will now be specifically described using examples, but the present invention is not limited to the examples.

Example 1

In this example, according to the process shown in FIGS. 2A to 2H, a liquid discharge head was produced. First, as shown in FIG. 2A, an 8-inch silicon substrate 1 having energy-generating elements 2 was prepared.

Then, as shown in FIG. 2B, a mold member 8 provided with a pattern of passages 14 was formed on a second surface of the substrate 1. Specifically, ODUR-1010 (trade name, manufactured by Tokyo Ohka Kogyo Co., Ltd.) was applied onto the second surface of the substrate 1 by spin coating, followed by pre-baking on a hot plate at 120° C. for 3 minutes and continuously in a nitrogen-purged oven at 150° C. for 30 minutes to form a film of 14 μm. The film was irradiated with Deep-UV light at an exposure dose of 18000 mJ/cm$^2$ using a Deep-UV exposure apparatus UX-3000 (trade name, manufactured by Ushio Inc.) through a mask having a passage pattern. Then, a development process was performed with a solution (MIBK/Xylene=⅔ (volume ratio)) composed of methyl isobutyl ketone (MIRK) and xylene (Xylene). Furthermore, rinse treatment with xylene (Xylene) was performed to form a mold member 8 for passages.

Then, as shown in FIG. 2C, a passage-forming member 7 having discharge openings 4 was formed on the substrate 1 and the mold member 8. Specifically, a negative photosensitive resin composition is applied onto the substrate 1 and the mold member 8 by spin coating, followed by pre-baking on a hot plate at 90° C. for 3 minutes to form a resin layer having a thickness of 10 μm. The composition. was as follows:

EHPE (trade name, manufactured by Daicel Corporation): 100 parts by mass,

SP-172 (trade name, manufactured by Adeka Corporation): 5 parts by mass,

A-187 (trade name, manufactured by Dow Corning Tardy Co., Ltd.): 5 parts by mass, and methyl isobutyl ketone: 100 parts by mass.

Subsequently, the resin layer was irradiated with ultraviolet light at an exposure dose of 3000 mJ/cm$^2$ using a mask aligner MPA600FA (trade name, manufactured by CANON KABUSHIKI KAISHA) through a photomask having a discharge opening pattern, followed by PEB at 90° C. for 180 seconds to cure the resin layer. Subsequently, a development process was performed using a solution composed of methyl isobutyl ketone and xylene (methyl isobutyl ketone/xylene=⅔ (volume ratio)). Furthermore, rinse treatment with xylene was performed to form a passage-forming member 7 having discharge openings 4.

Then, as shown in. FIG. 2D, common liquid chambers 3 and supply passages 6 were formed on the first surface side of the substrate 1. Specifically, the second surface side and the circumference of the substrate 1 were first coated with a rubber resin for protecting the passage-forming member 7. The first surface of the substrate 1 was then subjected to etching treatment and the rubber resin was removed to form common liquid chambers 3 and supply passages 6.

Then, as shown in FIG. 2E, a layer 5 containing a photosensitive resin composition was formed on a base film 9 to prepare a laminate 15, and the laminate 15 was stacked on the first surface of the substrate 1 such that the first surface was in contact with the photosensitive resin composition-containing layer 5. Specifically, a layer 5 containing a photosensitive resin composition was first formed on a base film 9. As the base film 9, Zeonor Film ZF16 50 μm. (trade name, manufactured by Zeon Corporation), which contains a cycloolefin polymer, was used. As the photosensitive resin composition, TMMR 52000 (trade name, manufactured by Tokyo Ohka Kogyo Co., Ltd.), which is a negative photosensitive resin composition, was used. The negative photosensitive resin composition was applied onto the base film 9 by spin coating to form a photosensitive resin composition-containing layer 5 having a thickness of 10 μm.

Figure 3:
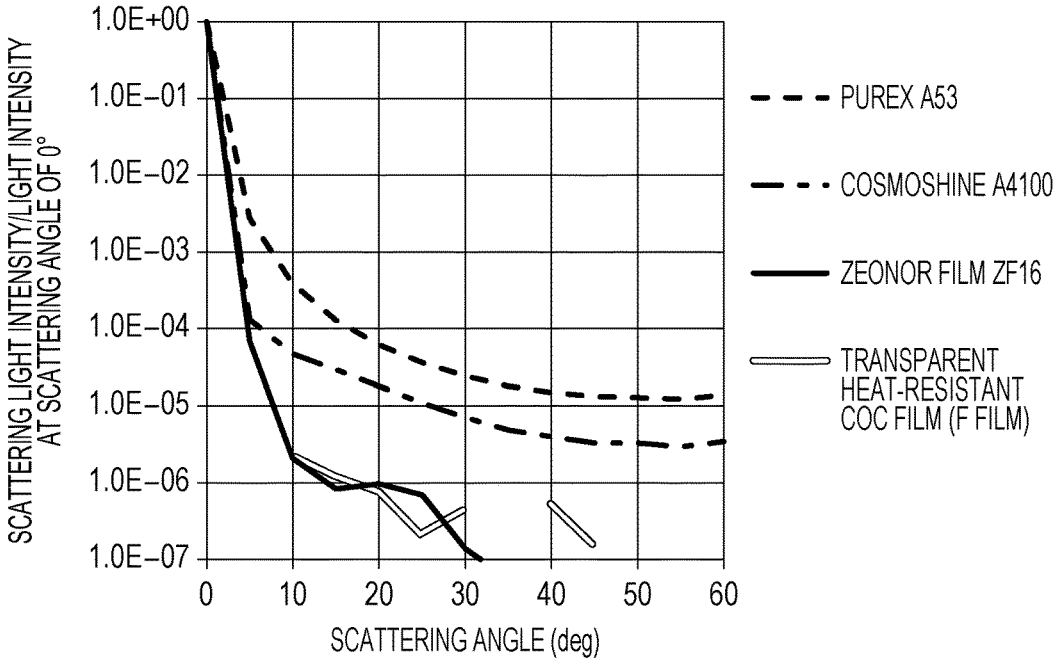
FIG. 3 is a graph showing a relationship between the scattering angle and the ratio of scattering light intensity/light intensity at a scattering angle of 0° in each base film.

The maximum scattering light intensity at a scattering angle of 10° or more of the Zeonor Film ZF16 was 1/480000 of the light intensity at a scattering angle of 0° when measured with GCMS-3B (trade name, manufactured by Murakami Color Research Laboratory) at a wavelength of 400 nm (FIG. 3). The surface roughness Sa of the Zeonor Film ZF16 was 1.4 nm when calculated from an image of 936.70 μm in length and 703.78 μm in breadth with VertScan (trade name, manufactured by Ryoka Systems Inc.). The contact angle with pure water of the Zeonor Film ZF16 was 100° when. measured with a contact angler meter CA-X150. The Zeonor Film ZF16 did not contain any filler and was not subjected to release treatment.

Subsequently, the laminate 15 was placed on the first surface of the substrate 1 such that the first surface was in contact with the photosensitive resin composition-containing layer 5, followed by laminating with a laminating apparatus. The conditions for the laminating were a stage temperature of 40° C., a roller temperature of 40° C., a roller pressure of 0.1 MPa, and a roller speed of 50 mm/s. Consequently, the laminate it was laminated on the first surface of the substrate 1.

Then, as shown in FIG. 2F, the laminate 15 was irradiated with exposure light 11 through a mask 10 having a pattern of the opening portions 13 of the lid structure 12. Specifically, the base film 9 and the photosensitive resin composition-containing layer 5 were irradiated with exposure light 11 at an exposure dose of 1000 mJ/cm$^2$ with an i-ray exposure apparatus capable of performing alignment through the mask 10 having a pattern of the opening portions 13 of the lid structure 12.

Then, as shown in FIG. 2G, the base film 9 was peeled from the photosensitive resin composition-containing layer 5, and a lid structure 12 having opening portions 13 was formed. Specifically, after the peeling of the base film 9, PEB was performed at 90° C. for 300 seconds to cure the photosensitive resin composition-containing layer 5, followed by development with propylene glycol 1-monomethyl ether 2-acetate. Thus, a lid structure 12 of 10 μm in thickness and having the opening portions 13 was formed.

Figure 4A:
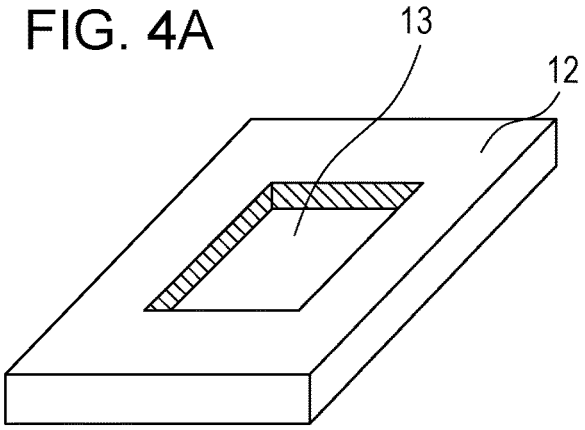
FIGS. 4A to 4C are schematic diagrams illustrating the shapes of the opening portion of each lid structure in examples and comparative examples.

Then, as shown in FIG. 2H, The mold member 8 was removed to form passages 14. Specifically, after irradiation with Deep-UV light, the mold member 8 was removed with methyl lactate to form passages 14, and a cure process was then performed at 200° C. for 1 hour. Thus, a liquid discharge head was produced. The thus-produced liquid discharge head was evaluated for the opening portions 13 of the lid structure 12, and good results for the pattern shape were obtained (FIG. 4A).

Example 2

A liquid discharge head was produced as in EXAMPLE 1 except that Transparent Heat-Resistant COC Film (F Film) 50 μm (trade name, manufactured by Gunze Limited), which contains a cycloolefin copolymer, was used as the base film 9. The maximum scattering light intensity at a scattering angle of 10° or more of the Transparent Heat-Resistant COC Film (F Film) was 1/410000 of the light intensity at a scattering angle of 0° when measured with GCMS-3B at a wavelength of 400 nm (FIG. 3). The surface roughness Sa of the Transparent Heat-Resistant COC Film (F Film) was 3.4 nm when calculated from an image of 936.70 μm in. length and 703.78 μm in breadth with VertScan. The contact angle with pure water of the Transparent Heat-Resistant COC Film (F Film) was 100° when measured with CA-X150. The Transparent Heat Resistant COC Film (F Film) was not subjected to release treatment. The liquid discharge head was evaluated for the opening portions 13 of the lid structure 12, and good results for the pattern shape were obtained (FIG. 4A).

Comparative Example 1

Figure 4B:
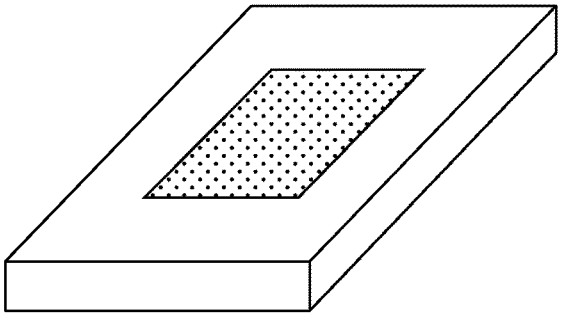

A liquid discharge head was produced as in EXAMPLE 1 except that Purex A-53 50 μm. (trade name, manufactured by Teijin DuPont Films Japan Ltd.), which contains a polyethylene terephthalate polymer, was used as the base film 9. The maximum scattering light intensity at a scattering angle of 10° or more of the Purex A-53 was 1/2600 of the light intensity at a scattering angle of 0° when measured with. GCMS-3B at a wavelength of 400 nm (FIG. 3). The surface roughness Sa of the Purex A-53 was 36.0 nm when calculated from an image of 936.70 μm in length and 703.78 μm in breadth with VertScan. The contact angle with pure water of the Purex A-53 was 110° when measured with CA-X150. The liquid discharge head was evaluated for the opening portions 13 of the lid structure 12, and blocking was partially observed in the patterned portion to be opened (FIG. 4B).

Comparative Example 2

Figure 4C:
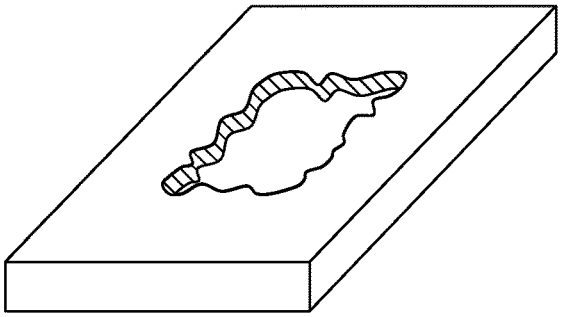

A liquid discharge head was produced as in EXAMPLE 1 except that Cosmoshine A4100 50 μm. (trade name, manufactured by Toyobo Co., Ltd.), which contains a polyethylene terephthalate polymer, was used as the base film 9. The maximum scattering light intensity at a scattering angle of 10° or more of the Cosmoshine A4100 was 1/21000 of the light intensity at a scattering angle of 0° when measured with GCMS-3B at a wavelength of 400 nm. (FIG. 3). The surface roughness Sa of the Cosmoshine A4100 was 1.1 nm when calculated from an image of 936.70 μm in length and 703.78 μm in breadth with VertScan. The contact angle with pure water of the Cosmoshine A4100 was 77° when measured with CA-X150. The Cosmoshine A4100 was not subjected to release treatment. The liquid discharge head was evaluated for the opening portions 13 of the lid structure 12, and defects were observed in a part of the pattern shape to be opened (FIG. 4C).

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-095348 filed May 11, 2016, which is hereby incorporated by reference herein in its entirety.

What is claimed is:

1. A method of producing a structure comprising a substrate having a plurality of openings in a first surface, a lid structure formed on the first surface of the substrate and having an opening portion communicating with a part of the plurality of openings, the method comprising, in the following order:

preparing a laminate by forming a layer containing a photosensitive resin composition on a base film;

stacking the laminate on the first surface of the substrate such that the first surface is in contact with the photosensitive resin composition-containing layer; and forming a pattern for the opening portion of the lid structure in the photosensitive resin composition-containing layer by pattern exposure of the photosensitive resin composition-containing layer through the base film, wherein the maximum scattering light intensity of the base film at a scattering angle of 10° or more is 1/100000 or less of the light intensity at scattering angle of 0°, at a wavelength of 400 nm.

2. The method of producing a structure according to claim 1, wherein the base film has a surface roughness of 10.0 nm or less.

3. The method of producing a structure according to claim 1, wherein the base film has a contact angle with pure water of 80° or more and less than 120°.

4. The method of producing a structure according to claim 1, wherein the base film is not subjected to release treatment.

5. The method of producing a structure according to claim 1, wherein the base film contains 3000 mass ppm or less of a filler.

6. The method of producing a structure according to claim 1, wherein the base film contains at least one member selected from the group consisting of cycloolefin polymers and cycloolefin copolymers.

7. The method of producing a structure according to claim 1, wherein the photosensitive resin composition is a negative photosensitive resin composition.

8. A method of producing a liquid discharge head comprising:

a substrate having a plurality of openings in a first surface and an energy-generating element disposed on a second surface on the side opposite to the first surface and generating energy for discharging a liquid;

a lid structure formed on the first surface of the substrate and having an opening portion communicating with a part of the plurality of openings; and a passage-forming member formed on the second surface of the substrate and having a discharge opening for discharging a liquid and a passage for the liquid, the method comprising, in the following order:

preparing a laminate by forming a layer containing a photosensitive resin composition on a base film;

stacking the laminate on the first surface of the substrate such that the first surface is in contact with the photosensitive resin composition-containing layer; and forming a pattern for the opening portion of the lid structure in the photosensitive resin composition-containing layer by pattern exposure of the photosensitive resin composition-containing layer through the base film, where _n the maximum scattering light intensity of the base film at a scattering angle of 10° or more is 1/100000 or less of the light intensity at a scattering angle of 0°, at a wavelength of 400 nm.

9. The method of producing a liquid discharge head according to claim 8, wherein the base film has a surface roughness of 10.0 nm or less.

10. The method of producing a liquid discharge head according to claim 8, wherein the base film has a contact angle with pure water of 80° or more and less than 120°.

11. The method of producing a liquid discharge head according to claim 8, wherein the base film is not subjected to release treatment.

12. The method of producing a liquid discharge head according to claim 8, wherein the base film contains 3000 mass ppm or less of a filler.

13. The method of producing a liquid discharge head according to claim 8, wherein the base film contains at least one member selected from the group consisting of cycloolefin polymers and cycloolefin copolymers.

14. The method of producing a liquid discharge head according to claim 8, wherein the photosensitive resin composition is a negative photosensitive resin composition.

* * * * *